US005671475A

United States Patent [19]

De Cock et al.

[11] Patent Number: 5,671,475

[45] Date of Patent: Sep. 23, 1997

[54] ELECTROSTATOGRAPHIC PRINTER FOR FORMING AN IMAGE ONTO A WEB AND FOR REFURBISHING THE PHOTOSENSITIVE DRUM

[75] Inventors: Etienne Marie De Cock; Lucien Amedé De Schamphelaere, both of Edegem; Jean Alois Rachel Norbert Van Daele, Bonheiden; Ludo Verluyten, Holsbeek, all of Belgium

[73] Assignee: Xeikon NV, Mortsel, Belgium

[21] Appl. No.: 398,893

[22] Filed: Mar. 6, 1995

[30] Foreign Application Priority Data

Mar. 11, 1994 [EP] European Pat. Off. ..... 94301782

[51] Int. Cl.[6] ..... G03G 21/00

[52] U.S. Cl. ..... 399/347; 399/384

[58] Field of Search ..... 355/296, 297, 355/300, 310, 326 R, 327, 211, 212; 118/652; 399/38, 384, 347

[56] References Cited

U.S. PATENT DOCUMENTS

| | | | |
|---|---|---|---|
| 2,796,367 | 2/1957 | Brown | 134/6 |
| 3,910,697 | 10/1975 | Lanker | 355/296 X |
| 4,279,500 | 7/1981 | Kondo et al. . | |
| 4,364,329 | 12/1982 | Murai et al. | 118/652 |
| 4,568,174 | 2/1986 | Stange | 355/296 X |
| 4,870,465 | 9/1989 | Lindblad et al. | 355/296 |
| 4,977,411 | 12/1990 | Pepe | 346/108 |
| 5,147,745 | 9/1992 | Russel | 430/49 |
| 5,148,639 | 9/1992 | Sakai et al. | 355/300 X |
| 5,179,416 | 1/1993 | Ku et al. | 355/297 |
| 5,274,428 | 12/1993 | Wong et al. | 355/326 R |
| 5,291,258 | 3/1994 | Cain et al. | 355/296 |

FOREIGN PATENT DOCUMENTS

| | | |
|---|---|---|
| 0156510 | 10/1985 | European Pat. Off. . |
| 2190060 | 1/1974 | France . |
| 7703327 | 2/1979 | Germany . |
| 58-68778 | 4/1983 | Japan . |
| 58-209773 | 12/1983 | Japan . |
| 62-40483 | 2/1987 | Japan . |
| 62-40485 | 2/1987 | Japan . |
| 62-297172 | 12/1987 | Japan . |
| 1-114883 | 5/1989 | Japan . |
| 5-085636 | 4/1993 | Japan . |
| 9321020 | 10/1993 | WIPO . |

OTHER PUBLICATIONS

Xerox Disclosure Journal vol.1, No. 7, Jul. 1976, p. 17 (Terzi et al.).

Xerox Disclosure Journal, vol. 2, No. 1, Jan./Feb. 1977, pp. 65–66, (Trainor).

"Electrophotography" by R.M. Schaffert, Focal Press 1975, pp. 57–59.

*Primary Examiner*—Robert Beatty

*Attorney, Agent, or Firm*—Brumbaugh, Graves, Donohue & Raymond

[57] ABSTRACT

An electrostatographic printer for forming an image onto a web comprises at least one toner image-producing electrostatographic station having a drum onto which a toner image can be formed, a transport for conveying a web past the image-producing station, apparatus for controlling the speed and tension of the web while it is running past the image-producing station, and transfer apparatus for transferring the toner image on the drum onto the web. The printer is characterized by a control arrangement for switching between a printing mode wherein a printing web moves in synchronism with the peripheral speed of the drum and a refurbishment mode wherein a refurbishment web moves at a faster speed relative to the peripheral speed of the drum and in contact therewith, to cause refurbishment of the drum surface.

24 Claims, 6 Drawing Sheets

ELECTROSTATOGRAPHIC PRINTER FOR FORMING AN IMAGE ONTO A WEB AND FOR REFURBISHING THE PHOTOSENSITIVE DRUM

FIELD OF THE INVENTION

This invention relates to an electrostatographic (for example multi-color) printer, in particular such a printer as is capable of printing color images for professional purposes as a cost effective alternative to conventional printing of short to medium sized runs.

BACKGROUND OF THE INVENTION

Electrostatographic printing operates according to the principles and embodiments of non-impact printing as described, e.g., in "Principles of Non-Impact Printing" by Jerome L. Johnson (1986)—Palatino Press—Irvine, Calif., 92715 USA).

Electrostatographic printing includes electrographic printing in which an electrostatic charge is deposited image-wise on a dielectric recording member (imaging member) as well as electrophotographic printing in which an overall electrostatically charged photoconductive dielectric recording member is image-wise exposed to conductivity increasing radiation producing thereby a "direct" or "reversal" toner-developable charge pattern on said recording member. "Direct" development is a positive-positive development, and is particularly useful for reproducing pictures and text. "Reversal" development is of interest in or when from a negative original a positive reproduction has to be made or vice-versa, or when the exposure derives from an image in digital electrical signal form, wherein the electrical signals modulate a laser beam or the light output of light-emitting diodes (LEDs). It is advantageous with respect to a reduced load of the electric signal modulated light source (laser or LEDs) to record graphic information (e.g. printed text) in such a way that the light information corresponds with the graphic characters so that by "reversal" development in the exposed area of a photoconductive recording layer, toner can be deposited to produce a positive reproduction of the electronically stored original. In high speed electrostatographic printing the exposure derives practically always from electronically stored, i.e. computer stored information.

As used herein, the term "electrostatographic" also includes the direct image-wise application of electrostatic charges on an insulating support, for example by ionography.

In U.S. Pat. No. 5,160,946 (Hwang assigned to Xerox Corporation) there is described an electrophotographic printing machine in which a plurality of image-forming units are arranged to superimpose toner images onto a motor-driven endless belt, from which the superimposed image is transferred to a paper sheet. Each image-forming unit includes a rotatable drum driven by a motor (see column 5, lines 22 to 27) in synchronism with the endless belt.

In U.S. Pat. No. 3,694,073 (Bhagat/Xerox Corporation) a printer is described in which toner images formed on a plurality of rotatable drums are successively transferred to a support material in the form of a web moving in synchronism with the speed of the surface of the drums. After transfer, excess toner is removed from the drums by cleaning brushes.

During extended use, the surface of the drums may become superficially damaged, resulting in scratches which accumulate compressed toner (a phenomenon known as filming and scumming) whereby toner material can not be removed by the cleaning brushes. The retained toner material may produce unwanted marks on the printed image.

The problem of filming and scumming on a photoreceptor due to smeared out toner particles has been described in Xerox Disclosure Journal—Volume 2, Number 1 January/February 1977. In that publication it is proposed to modify a brush cleaner to allow abrasion and removal of any film build-up on the toner-receiving surface (photoreceptor surface). If the interference of the cleaning brush with the photoreceptor surface is greater than some critical value, abrasion of the surface along with any film thereon results.

In Xerox Disclosure Journal—Volume 1, Number 7 July 1976 a method is described wherein a photoreceptor, in particular selenium, is pumiced to remove minor defects and scratches. The photoreceptor is rotated at a given speed while conventional advanceable toner cleaning web is applied against it under pressure. The web is impregnated with a pumicing agent, and automatically pumices the drum until the scratch or defect is removed.

Refurbishment of a photoconductor surface by removal of a thin stratum thereof acts as a kind of rejuvenation and is in favor of image quality. If during printing, an abrasive cleaning means is engaged with a rotating imaging member, a strong and not easily controllable torque would be applied thereto, with the result that the imaging member would no longer rotate in synchronism with the support material web. In a multistation printer operating with rotatable imaging drums, this synchronism is essential for avoiding registration problems.

SUMMARY OF THE INVENTION

It is an object of the present invention to enable refurbishment of the photo-receptor surface of an electrostatographic printer in a simple and convenient manner.

According to a first aspect of the invention, there is provided an electrostatographic printer for forming an image onto a web, which comprises:

- at least one toner image-producing electrostatographic station having rotatable endless surface means onto which a toner image can be formed;
- means for conveying the web past the image-producing station; and
- transfer means for transferring the toner image on the rotatable endless surface means onto the web, characterized by switching means for switching the printer between a printing mode and a cleaning mode, wherein in the printing mode the web is a printing web which moves in synchronism with the peripheral speed of the rotatable endless surface means and in the cleaning mode the web is a cleaning web which moves at such a speed relative to the peripheral speed of the rotatable endless surface means and in contact therewith, to cause refurbishment of the rotatable endless surface means.

Usually, the rotatable endless surface means (imaging member) comprises a belt or the circumferential surface of a drum, especially a belt or drum which has a photoconductive surface. In the following general description, reference is made to a drum, but it is to be understood that such references are also applicable to endless belts or to any other form of endless surface means.

Preferably, the printer according to the invention further comprises means for controlling the speed and tension of the web while it is running past the image-producing station.

In the printing mode, adherent contact of the printing web with the drum surface is preferably such that the movement of the printing web controls the peripheral speed of the drum in synchronism with the movement of the printing web.

In a preferred embodiment, the printer is an electrostatographic single-pass multiple station printer, which comprises a plurality of toner image-producing electrostatographic stations each having a drum onto which a toner image can be formed, and means for conveying the web in succession past said stations.

Drive means, such as a drive motor, may be provided to rotationally drive each drum, control means being provided to ensure that, in the printing mode, the movement of the printing web is in synchronism with the peripheral speed of the drums.

However, in a more preferred embodiment, the printer comprises guiding means which determine for the web wrapping angles about the drums, such that adherent contact of said web with each drum is such that the movement of said web controls the peripheral speed of the drums in synchronism with the movement of the web.

By stating that the adherent contact of the web with said rotatable endless surface means is such that the moving web controls the peripheral speed of said surface means, we mean that the only torque, or substantially the only torque, which is applied to said endless surface means is derived from the adherent contact between the web and the endless surface means. As explained further below, since no other, or substantially no other, resultant force is acting upon the endless surface means, the endless surface means is constrained to rotate in synchronism with the moving web.

At least partly, the adherent contact comes from the transfer means being a corona discharge device providing electrostatic adhesion between the web and the endless surface means.

According to the present invention said adherent contact results also from a mechanical contact obtained by guiding and tensioning said web over a certain wrapping angle in contact with said rotatable endless surface means.

The or each toner image-producing electrostatographic station preferably comprises means for charging the surface of the drum, and usually the surface of the drums at all the image-producing stations are charged to the same polarity. Using photoconductors of the organic type, it is most convenient to charge the surface of the drums to a negative polarity and to develop the latent image formed thereon in reversal development mode by the use of a negatively charged toner.

Refurbishment of a photoconductor surface by removal of a thin stratum (e.g. less than 0.1 μm) on a total thickness of e.g. 18 μm, acts as a kind of rejuvenation and is in favor of image quality. This has been found to be true as both for inorganic as organic photoconductive layers, that may be present in recording materials with active single or dual layers.

Organic photoconductive (OPC) materials with two recording active layers contain a combination of a charge generating layer (CGL) and charge transporting layer (CTL). A detailed description of such OPC materials can be found in the prior art and subject matter described in published European patent applications EP 393787, 573084 and U.S. Pat. No. 4,943,502 (all Agfa-Geveart NV).

The means for image-wise exposing the charged surface of the drum or belt may comprise an array of image-wise modulated light-emitting diodes or take the form of a scanning laser beam.

The toner will usually be in dry particulate form, but the invention is equally applicable where the toner particles are present as a dispersion in a liquid carrier medium or in a gas medium in the form of an aerosol.

It is convenient for each image-producing station to comprise a driven rotatable magnetic developing brush and a driven rotatable cleaning brush, both in frictional contact with the drum surface. We have found that by arranging for the developing brush and the cleaning brush to rotate in opposite senses, it can be assured that the resultant torque applied by the brushes to the drum surface is at least partly cancelled out. In particular, we prefer that the extents of frictional contact of the developing brush and of the cleaning brush with the drum surface are such that the resultant torque transmitted to the drum surface is substantially zero. By stating that the resultant torque transmitted to the drum surface is substantially zero is meant that any resultant torque acting upon the drum surface is smaller than the torque applied by the web to the drum surface.

To achieve this in a practical manner, the position and/or the speed of at least one of said brushes relative to the drum surface may be adjustable thereby to adjust the extent of frictional contact between that brush and the drum surface.

In one embodiment of the invention, the web is a final support for the toner images and is unwound from a roll, image-fixing means being provided for fixing the transferred images on the web. In this embodiment, the printer may further comprise a roll stand for unwinding a roll of web to be printed in the printer, and a web cutter for cutting the printed web into sheets. The drive means for the web may comprise one or more drive rollers, preferably at least one drive roller being positioned downstream of the image-producing stations and a brake or at least one drive roller being positioned upstream of the image forming stations. The speed of the web through the printer and the tension therein is dependent upon the speed and the torque applied to these drive rollers.

For example, one may provide two motor driven drive rollers, one driven at a constant speed defining the web speed and the other driven at constant torque defining the web tension. Preferably the web is conveyed through the printer at a speed of from 5 cm/sec to 50 cm/sec and the tension in the web at each image-producing station preferably lies within the range of 0.2 to 2.0N/cm web width.

The adherent contact mentioned hereinbefore is obtained at least partly by guiding means, for example freely rotating rollers, positioned to define a wrapping angle with respect to the rotatable surface means, preferably a wrapping angle of from 5° to 30°, preferably from 10° to 20°. The guiding means contacts the web on the side thereof opposite to that on which the toner images are transferred. The guiding means are preferably guiding rollers but may, for example, alternatively be formed by stationary air-bearings.

The transfer means is in the form of a corona discharge device which sprays charged particles having a charge opposite to that of the toner particles. The supply current fed to the corona discharge device is preferably within the range of 1 to 10 μA/cm web width, most preferably from 2 to 5 μA/cm web width, depending upon the paper characteristics and will be positioned at a distance of from 3 mm to 10 mm from the path of the web.

In preferred embodiments of the invention, the drum comprises a photoconductive surface and the image-producing station further comprises:

- means for charging the drum;
- means for forming an electrostatic latent image on the drum; and
- a developing unit for depositing toner onto the electrostatic latent image.

The switching means may include means for moving the developing unit away from the drum in the cleaning mode.

To achieve this, the developing unit may be pivotally or slidingly mounted in the printer. The means for moving the developing unit may be automatically or manually actuated.

Drive means may be provided for rotating the drum in the cleaning mode, optionally at a higher peripheral speed than in the printing mode, these drive means being disengaged in the printing mode. These drive means may include a pulley wheel and drive belt assembly, in which movement of the developing unit into the cleaning mode position tensions the drive belt to enable drive to be transferred to the drum while movement of the developing unit into the printing mode position slackens the drive belt thereby disengaging the drive to the drum.

According to a second aspect of the invention, there is provided a process of operating an electrostatographic printer comprising:

at least one toner image-producing electrostatographic station having rotatable endless surface means onto which a toner image can be formed;

means for conveying the web past the image-producing station; and transfer means for transferring the toner image on the rotatable endless surface means onto the web, the method being characterized by a printing step in which the web is a printing web which moves in synchronism with the peripheral speed of the rotatable endless surface means, and a cleaning step in which the web is a cleaning web which moves at such a speed relative to the peripheral speed of the rotatable endless surface means and in contact therewith, to cause refurbishment of the rotatable endless surface means.

In one embodiment of the invention, the cleaning web is a continuation of the printing web. The cleaning web may be in the form of a leader tape attached to the printing web. The cleaning web may comprise an abrasive surface, constituted for example by an abrasive sheet secured to the cleaning web, by an abrasive coating formed on at least one face of the cleaning web, or by an abrasive strip positioned obliquely across the cleaning web. Where the printer is a multiple-station duplex printer, the cleaning web may be provided with an abrasive surface on both faces. Alternatively, the printing web itself may be used as the cleaning web.

Alternatively, the cleaning web is separate from the printing web and the printer further comprises a cleaning web station having cleaning web supply means and cleaning web take-up means, wherein the cleaning step includes moving the cleaning web station towards the drum to bring the cleaning web into contact therewith.

In either embodiment, the cleaning web may contain successive abrasive cleaning materials having a diminishing abrasive character. Thus, refurbishment can be carried out in successive stages using more abrading material up to relatively smooth polishing material. The abrasion can be further controlled by contact pressure between the abrasive material and the toner developed recording surface to be cleaned.

Abrasive web-type elements particularly suited for refurbishment of photoconductive surfaces contain in a binder layer resin-bonded particulate abrasive substances of an average particle size less than 30 μm protruding from the surface in such a degree that an average surface roughness (Ra) is less than 7 μm. Surface roughness is measured with a PERTHOMETER S6P (tradename of Mahr-Perthen, Germany). Particularly useful abrasive substances are aluminum oxide, chrome oxide, cerium oxide, silicon carbide and cubic boron nitride, but polishing may proceed with much softer substances such as calcite, having a Mohs hardness of about 3.

In particular with the Microfinishing Products of 3M St. Paul, Minn. 55144-1000 USA, e.g. IMPERIAL MICROFINISHING FILM IMPERIAL LAPPING FILM and IMPERIAL POLISHING FILM (tradenames of 3M) good results in defilming and descumming are obtained.

According to a special embodiment improvements in smoothness and imaging quality of the recording layer are obtained by abrading and polishing contact with paper used as printing stock.

The printer construction according to the invention is particularly advantageous where the printer is a multi-color printer comprising magenta, cyan, yellow and black printing stations.

PREFERRED EMBODIMENTS OF THE INVENTION

The invention will now be further described, purely by way of example, with reference to the accompanying drawings, in which.

Figure 1:
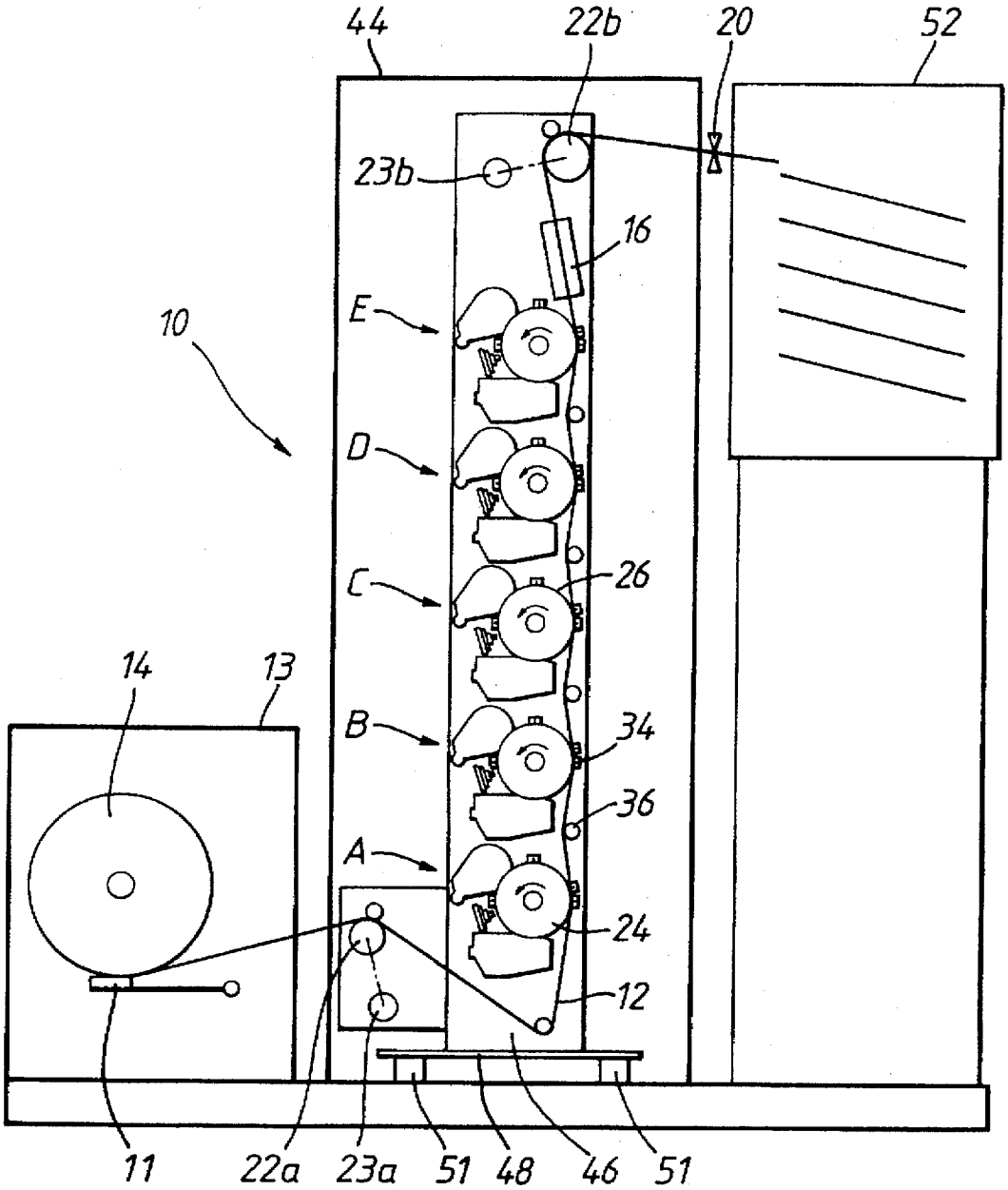
FIG. 1 shows schematically an electrostatographic single-pass multiple station printer, suitable for simplex printing, showing the positional relationship of the various parts thereof.

Referring to FIG. 1, there is shown a printer having a supply station 13 in which a roll 14 of web material 12 is housed, in sufficient quantity to print, say, up to 5,000 images. The web 12 is conveyed into a tower-like printer housing 44 in which a support column 46 is provided, housing four similar printing stations A to D. In addition, a further station E is provided in order to optionally print an additional color, for example a specially customized color, for example white. The printing stations A to E are mounted in a substantially vertical configuration resulting in a reduced footprint of the printer and additionally making servicing easier. The column 46 may be mounted against vibrations by means of a platform 48 resting on springs 51.

After leaving the final printing station E, the image on the web is fixed by means of the image-fixing station 16 and fed to a cutting station 20 (schematically represented) and a stacker 52 if desired.

The web 12 is conveyed through the printer by two drive rollers 22*a*, 22*b* one positioned between the supply station 13 and the first printing station A and the second positioned between the image-fixing station 16 and the cutting station 20. The drive rollers 22*a*, 22*b* are driven by controllable motors, 23*a*, 23*b*. One of the motors 23*a*, 23*b* is speed controlled at such a rotational speed as to convey the web through the printer at the required speed, which may for example be about 125 mm/sec. The other motor is torque controlled in such a way as to generate, in conjunction with brake 11, a web tension of, for example, about 1 N/cm web width.

The printing stations (i.e. image-producing stations) A, B, C, D and E are arranged in a substantially vertical configuration, although it is of course possible to arrange the stations in a horizontal or other configuration. The web of paper 12 unwound from the supply roller 14 is conveyed in an upwards direction past the printing stations in turn. The moving web 12 is in face-to-face contact with the drum surface 26 over a wrapping angle ω of about 15° (see FIG. 2) determined by the position of the guide rollers 36. After passing the last printing station E, the web of paper 12 passes through the image-fixing station 16, an optional cooling zone (not shown) and thence to the cutting station 20 to cut the web 12 into sheets. The web 12 is conveyed through the printer by the motor-driven drive rollers 22*a*, 22*b* and tension in the web is generated by the application of the brake 11 acting upon the supply roller 14.

Figure 2:
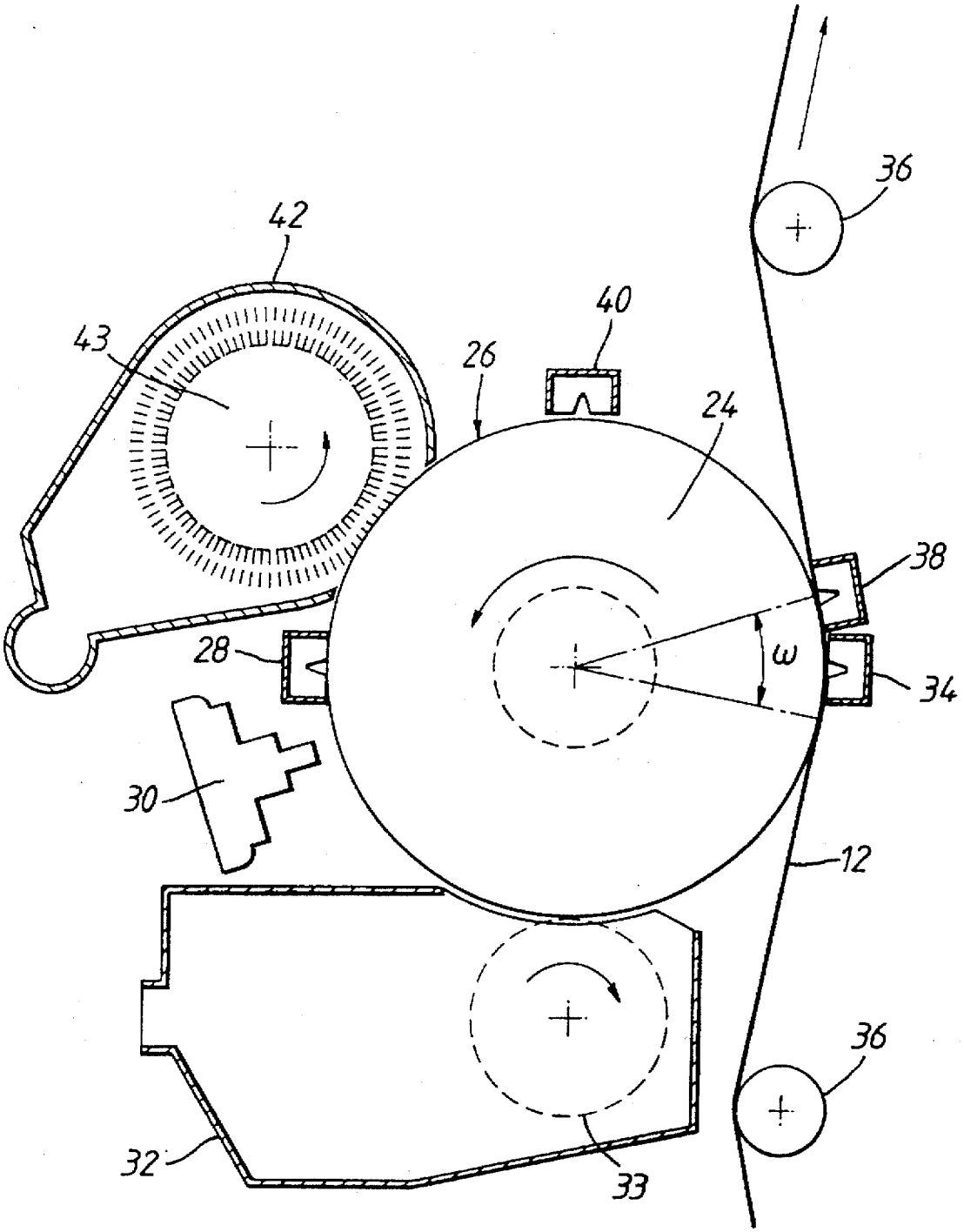
FIG. 2 shows in detail a cross-section of one of the printing stations of the printer shown in FIG. 1.

As shown in FIG. 2, each printing station comprises a cylindrical drum 24 having a photoconductive outer surface 26. Circumferentially arranged around the drum 24 there is a main corotron or scorotron charging device 28 capable of uniformly charging the drum surface 26, for example to a potential of about −600 V, an exposure station 30 which may, for example, be in the form of a scanning laser beam or an LED array, which will image-wise and line-wise expose the photoconductive drum surface 26 causing the charge on the latter to be selectively reduced, for example to a potential of about −250 V, leaving an image-wise distribution of electric charge to remain on the drum surface 26. This so-called "latent image" is rendered visible by a developing unit 32 which by means known in the art will bring a developer in contact with the drum surface 26. The developing unit 32 includes a developer brush 33 which is adjustably mounted, enabling it to be moved radially towards or away from the drum 24 for reasons as will be explained further below. According to one embodiment, the developer contains (i) toner particles containing a mixture of a resin, a dye or pigment of the appropriate color and normally a charge-controlling compound giving triboelectric charge to the toner, and (ii) carrier particles charging the toner particles by frictional contact therewith. The carrier particles may be made of a magnetizable material, such as iron or iron oxide. In a typical construction of a developing unit, the developer brush 33 contains magnets carried within a rotating sleeve causing the mixture of toner and magnetizable material to rotate therewith, to contact the surface 26 of the drum 24 in a brush-like manner. Negatively charged toner particles, triboelectrically charged to a level of, for example 9 μC/g, are attracted to the photo-exposed areas on the drum surface 26 by the electric field between these areas and the negatively electrically biased developer so that the latent image becomes visible.

After development, the toner image adhering to the drum surface 26 is transferred to the moving web 12 by a transfer corona device 34. The moving web 12 is in face-to-face contact with the drum surface 26 over a wrapping angle ω of about 15° determined by the position of guide rollers 36. The charge sprayed by the transfer corona device, being on the opposite side of the web to the drum, and having a polarity opposite in sign to that of the charge on the toner particles, attracts the toner particles away from the drum surface 26 and onto the surface of the web 12. The transfer corona device typically has its corona wire positioned about 7 mm from the housing which surrounds it and 7 mm from the paper web. A typical transfer corona current is about 3 μA/cm web width. The transfer corona device 34 also serves to generate a strong adherent force between the web 12 and the drum surface 26, causing the latter to be rotated in synchronism with the movement of the web 12 and urging the toner particles into firm contact with the surface of the web 12. The web, however, should not tend to wrap around the drum beyond the point dictated by the positioning of a guide roller 36 and there is therefore provided circumferentially beyond the transfer corona device 34 a web discharge corona device 38 driven by alternating current and serving to discharge the web 12 and thereby allow the web to become released from the drum surface 26. The web discharge corona device 38 also serves to eliminate sparking as the web leaves the surface 26 of the drum.

Thereafter, the drum surface 26 is pre-charged to a level of, for example −580 V, by a pre-charging corotron or scorotron device 40. The pre-charging makes the final charging by the corona 28 easier. Thereby, any residual toner which might still cling to the drum surface may be more easily removed by a cleaning unit 42 known in the art. The cleaning unit 42 includes an adjustably mounted cleaning brush 43, the position of which can be adjusted towards or away from the drum surface 26 to ensure optimum cleaning. The cleaning brush 43 is earthed or subject to such a potential with respect to the drum as to attract the residual toner particles away from the drum surface. After cleaning, the drum surface is ready for another recording cycle.

After passing the first printing station A, as described above, the web passes successively to printing stations B, C and D, where images in other colors are transferred to the web. It is critical that the images produced in successive stations be in register with each other. In order to achieve this, the start of the imaging process at each station has to be critically timed. However, accurate registering of the images is possible only if there is no slip between the web 12 and the drum surface 26.

The electrostatic adherent force between the web and the drum generated by the transfer corona device 34, the wrapping angle ω determined by the relative position of the drum 24 and the guide rollers 36, and the tension in the web generated by the drive rollers 22*a*, 22*b* and the braking effect of the brake 11 are such as to ensure that the peripheral speed of the drum 24 is determined substantially only by the movement of the web 12, thereby ensuring that the drum surface moves synchronously with the web.

The rotatable cleaning brush 43 which is driven to rotate in a sense the same as to that of the drum 24 and at a peripheral speed of, for example twice the peripheral speed of the drum surface. The developing unit 32 includes a developer brush 33 which rotates in a sense opposite to that of the drum 24. The resultant torque applied to the drum 24 by the rotating developing brush 33 and the counter-rotating cleaning brush 43 is adjusted to be close to zero, thereby ensuring that the only torque applied to the drum is derived from the adherent force between the drum 24 and the web 12. Adjustment of this resultant force is possible by virtue of the adjustable mounting of the cleaning brush 43 and/or the developing brush 33 and the brush characteristics.

Figure 2A:
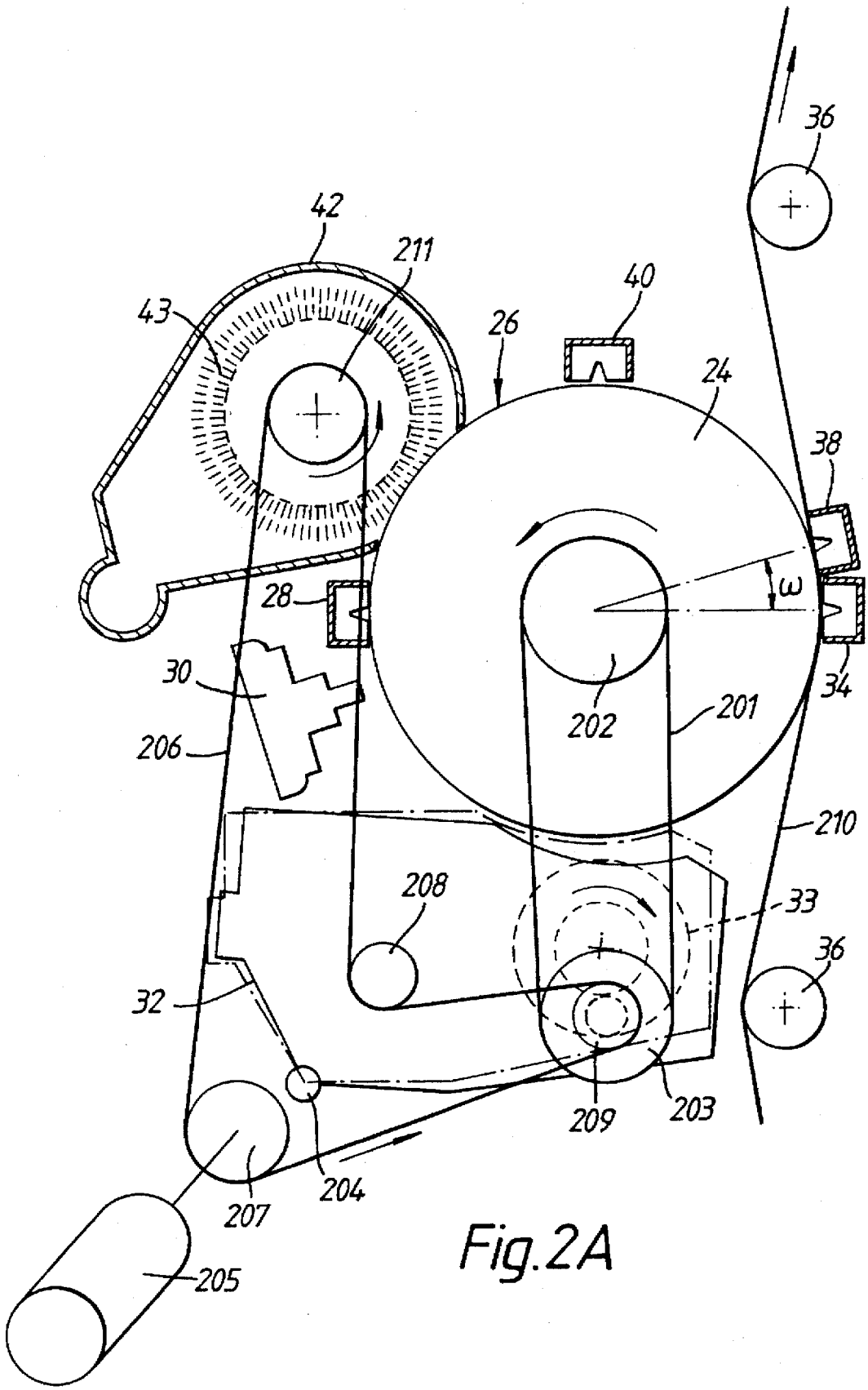
FIG. 2A shows a modification of the printing station shown in FIG. 2, incorporating the invention.

A preferred embodiment of a printing station operating according to the invention is illustrated in FIG. 2A which represents a modified embodiment of the printing station represented in the preceding FIG. 2. FIG. 2A illustrates the position during the cleaning mode. In this mode, a cleaning web having abrasive cleaning properties follows the same path as the printing web 12 in the printing mode. The cleaning web 210 is coated with or has attached thereto an abrasive layer or an abrasive sheet or ribbon. Alternatively, the cleaning web 210 is a continuation of the printing web.

In the embodiment illustrated in FIG. 2A the photoconductive recording drum 24 is driven rotationally by means of a first drive belt 201 running in the rim of a pulley wheel 202 drivingly connected to the shaft of said drum. The same belt 201 runs over an inner pulley wheel 203 of a double pulley assembly, the shaft of which is supported in a ball-bearing from a side wall of the developing unit 32. The belt 201 is tensioned by pivoting the developing unit 32 around a pivot point 204. In FIG. 2A the position of the developing unit 32 in the printing mode is shown in dashed lines; the position of the developing unit 32 in the cleaning mode is shown in solid lines.

In the printing mode, with the developing unit 32 pivoted into the position shown in dashed lines in FIG. 2A, tension in the first drive belt 201 is lost, thereby ensuring that no drive is transferred thereby to the drum 24.

The other pulley wheel 209 of the double pulley assembly is driven by a second drive belt 206 which is driven by an electric motor 205 via a motor-shaft mounted drive pulley wheel 207. The second drive belt 206 also provides rotational motion to the magnetic developing brush 33 and the cleaning brush 43, coupled to a pulley 211. Drive from the pulley wheel 209 passes through a toothed wheel mounted on its shaft engaged with a toothed wheel mounted on the shaft of the magnetic brush (the toothed wheels are not shown in the drawing) to cause the magnetic developing brush 33 to rotate in a sense opposite to the sense of rotation of the cleaning brush 43. A guiding roller 208 provides the necessary belt-tension to second drive belt 206. In order to reduce slippage, the rims of the pulley wheels 202, 203, 207 and 209 are indented and the belts have a toothed structure meshing with the indentation of said rims.

Figure 3:
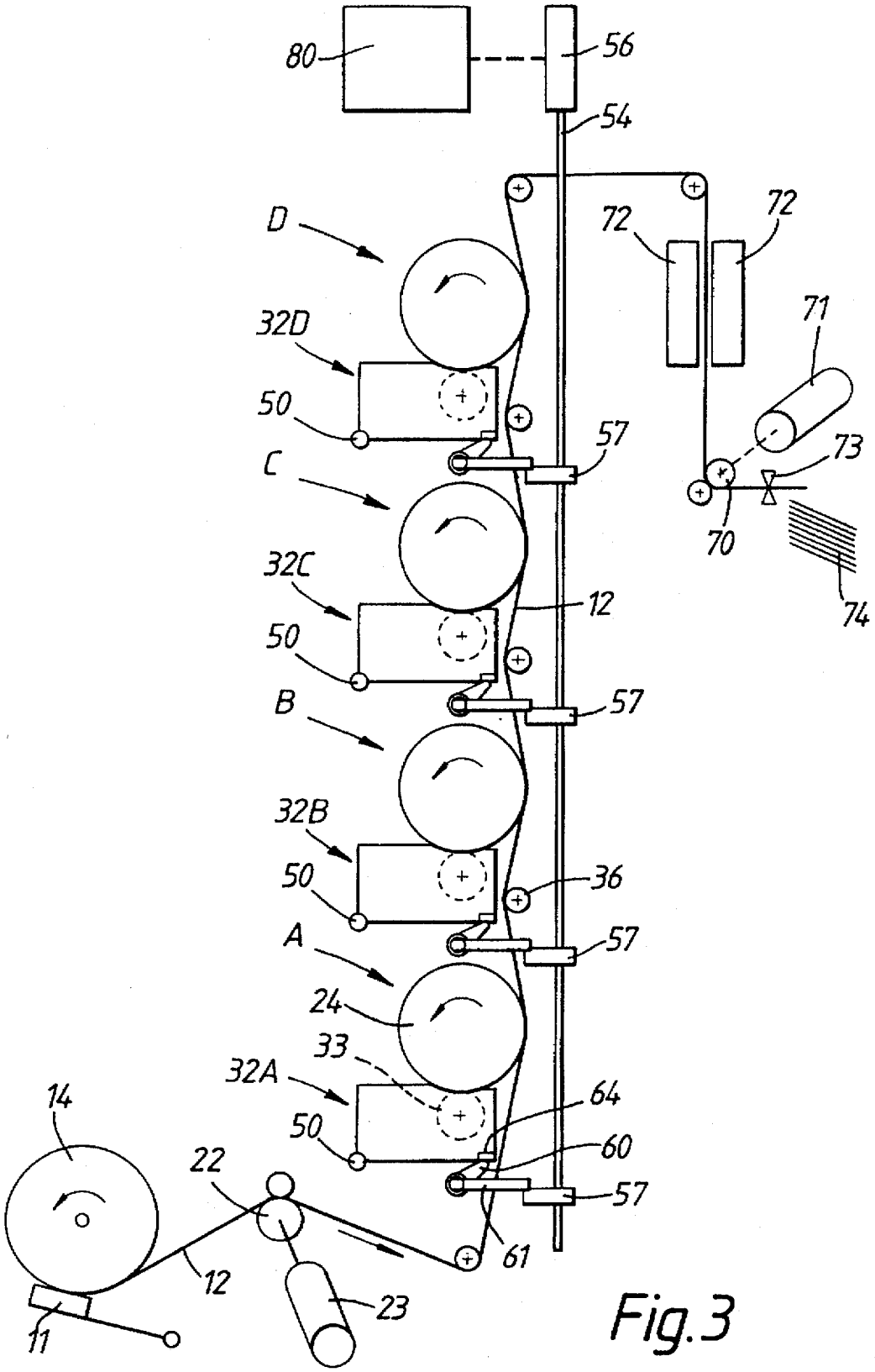
FIG. 3 shows schematically an electrostatographic single-pass multiple station printer containing four printing stations.

FIG. 3 shows schematically an electrostatographic single-pass multiple station printer containing four printing stations A, B, C and D with which pivotable developing units 32A, 32B, 32C and 32D are associated respectively. The position, either printing or cleaning, of each developing unit 32 is switched through a lever mechanism in which a latch lever 60 fixedly united with a swingable lever 61 retains the right hand frame side of developing unit at a centrally located touch point 64.

The printing stations are again arranged in a substantially vertical configuration. The web of paper 12 unwound from the supply roller 14 is conveyed in upwards direction past the printing stations in turn. The web 12 is conveyed through the printer by a drive roller 22 driven by a speed motor 23 and tension in the web is controlled by a drive roller 70 connected to a torque motor 71. The brake 11 acts upon the supply roller 14 as a torque balancing element.

The developing units 32A, 32B, 32C and 32D are each pivotally movable around a shaft 50 mounted in a bearing on a frame member (not shown in the drawing) of the printer.

The simultaneous displacement of each of the developing units is controlled by control means 80 which controls a linear electric motor 56 connected to a common rod 54 with cantilever elements 57 each engaged with a lever mechanism comprising swingable lever 61 and latch lever 60 fixed thereto. The latch lever 60 supports the developing unit at a centrally located touch point 64. By a reciprocating movement of the rod 54 the developing units are brought in either the printing position or in the cleaning position.

As shown in FIG. 3 the toner receiving web 12 is unwound from the roll 14 and after transfer of several toner images thereon the toner images are fixed with radiant heat provided by a fixing unit 72. After fixing the toner images the toner receiving web 12 is cut by a cutting means 73 to yield sheets containing the desired image format for receipt in a tray or sheet collector 74.

Figure 4:
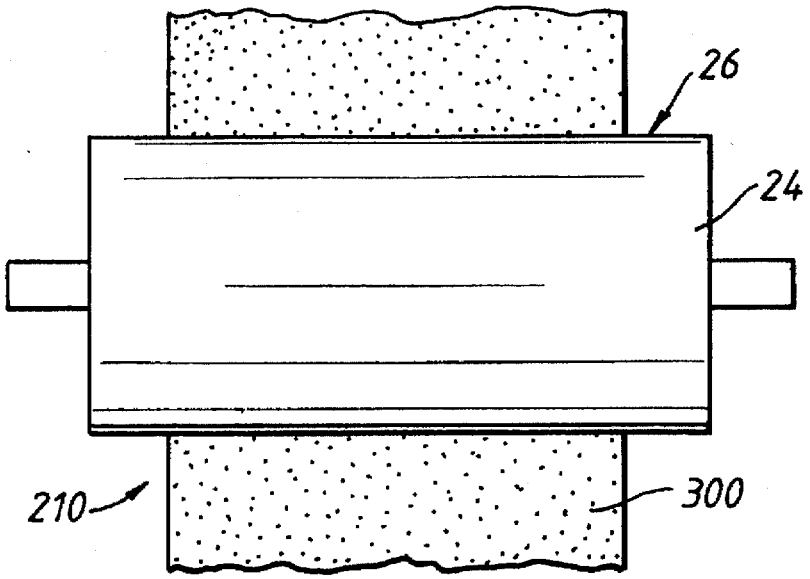
FIG. 4 shows a cleaning web for use in a printer according to the invention.
Figure 5:
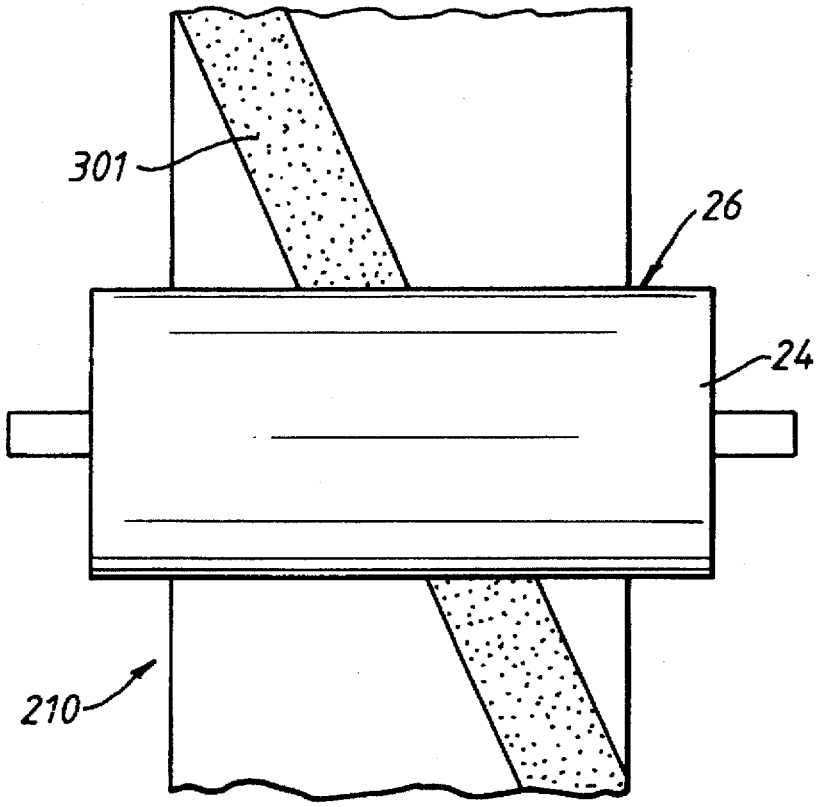
FIG. 5 shows an alternative cleaning web for use in a printer according to the invention.

During the period of time that the developing unit 32 is pivoted away from the drum 24, i.e. in the cleaning mode, the magnetic developing brush 33 no longer makes contact with the drum surface 26. In that period of time the cleaning web 210 carrying an abrasive coating 300 (see FIG. 4) or having an abrasive stripe 301 (see FIG. 5) adhered on at least one face thereof is moved rapidly in contact with the drum surface 26 using the same driving mechanism as used for moving the printing web 12 in the printing mode. The pivoting of the developing unit 32 between the printing mode position and the cleaning mode position may be carried out automatically or manually by the machine operator.

The web 210 having abrasive properties may be in the form of a leader tape attached to and preceding the beginning of the printing web 12, so that before starting a printing run refurbishment is carried out. Alternatively, the leader tape may be attached to the trailing end of the printing web 12. The width of the cleaning web may be somewhat larger than the width of the printing web 12.

By the refurbishment any residual toner and a thin stratum of the photoconductive layer 26 of the drum 24 is removed. More particularly by the abrasive treatment toner is removed that has been captured in small scratches of the recording surface and gives unwanted image marks such as lines, spots and smudges in successive prints.

For a good cleaning action the peripheral speed of the drum 24 relative to said cleaning web 210 is preferably in the range between 150 to 220 cm/s.

The cleaning web 210 is advanced from a supply station, for example at a speed of 1.5 cm/s, in order that successive portions of the web engage the drum surface 26. In that way during cleaning a fresh portion of abrasive cleaning web is in engagement with said drum surface.

Figure 6:
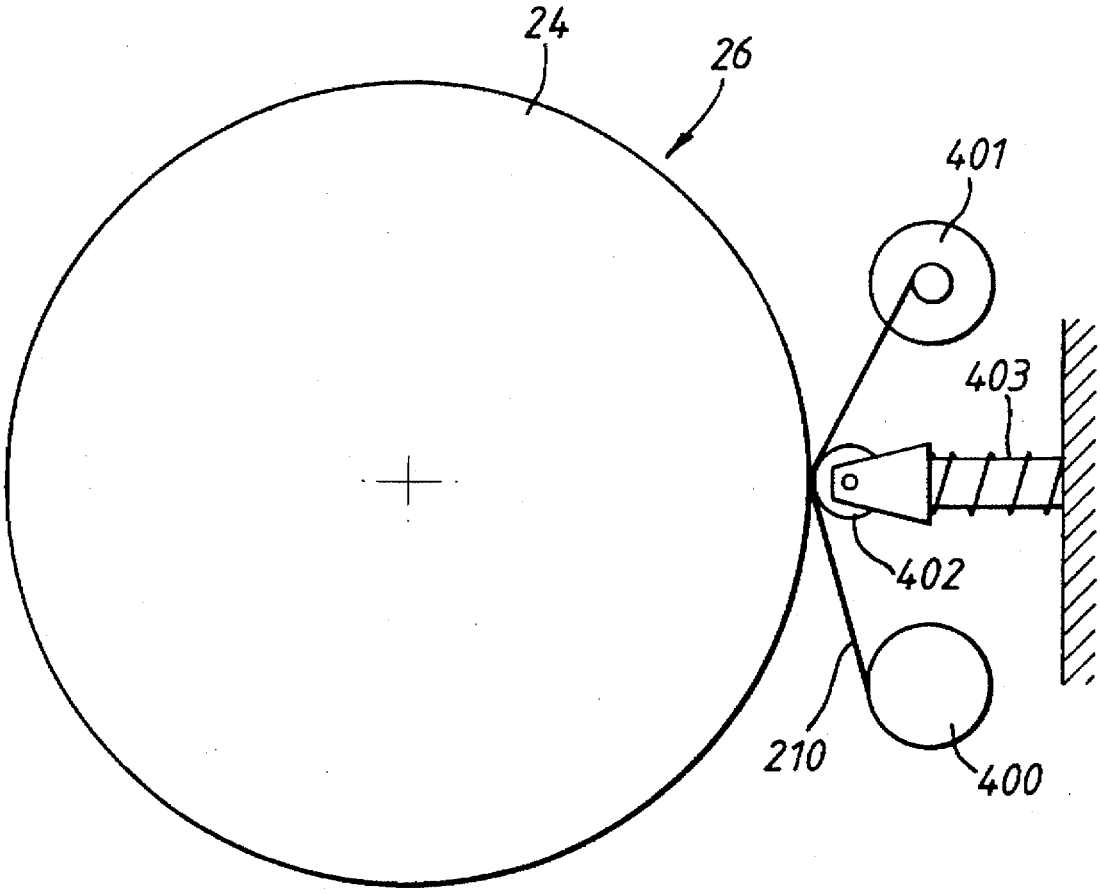
FIG. 6 shows part of an alternative embodiment of the invention.

In accordance with an alternative embodiment of the present invention illustrated in FIG. 6, using a cleaning web which is separate from the printing web, the printer comprises a cleaning web station in which a cleaning web 210 is supplied from a supply station including a first spool 400 storing an unused portion of said cleaning web and a receiving station including a second spool 401 for accepting used portions of said web after pressure contact with the surface to be cleaned. Said pressure contact is realized in the cleaning mode of the printer by a means of a mechanically retractable spring 403 urging a pressure roller 402 against the smooth rear side of the web 210. That pressure may be obtained likewise pneumatically or by magnetic force (magnetic chuck) bringing the abrasive web 210 into and out of engagement with said rotatable endless surface means.

The cleaning web station illustrated in FIG. 6 may replace the above described pivotable developing unit 32 during its servicing.

CROSS-REFERENCE TO CO-PENDING APPLICATION

A number of features of the printers described herein are the subject matter of co-pending European patent application no. EP-A-629924 (Xeikon NV).

We claim:

1. An electrostatographic printer for forming an image onto an image receiving web, which comprises:

at least one toner image-producing electrostatographic station having a rotatable endless surface onto which a toner image can be formed;

a web transport for conveying a web past said image-producing station; and image transfer apparatus for transferring said toner image on said rotatable endless surface onto said image receiving web, further comprising a control arrangement for switching said printer between a printing mode and a refurbishment mode, wherein in said printing mode said web transport conveys said image receiving web in synchronism with the peripheral speed of said rotatable endless surface and in said refurbishment mode said web transport conveys a refurbishment web at such a speed relative to the peripheral speed of said rotatable endless surface and in contact therewith, to cause refurbishment of said rotatable endless surface; said control arrangement including a drive for rotating said rotatable endless surface in said refurbishment mode at a higher peripheral speed than in said printing mode.

2. A printer according to claim 1, further comprising means for controlling the speed and tension of said image receiving web while it is running past said image-producing station.

3. A printer according to claim 1, wherein, in said printing mode, adherent contact of said image receiving web with said rotatable endless surface is such that the movement of said image receiving web controls the peripheral speed of said endless surface in synchronism with the movement of said image receiving web.

4. A printer according to claim 1, wherein said image receiving web is a final support for said toner images and is unwound from a roll, image-fixing means being provided for fixing said transferred toner images on said image receiving web.

5. A printer according to claim 4, which further comprises a roll stand for unwinding a roll of image receiving web, and a web cutter for cutting said image receiving web into sheets.

6. A printer according to claim 1, wherein said rotatable endless surface comprises a photoconductive surface and said image-producing station further comprises:

means for charging said rotatable endless surface;

means for forming an electrostatic latent image on said rotatable endless surface; and a developing unit for depositing toner onto said electrostatic latent image.

7. A printer according to claim 6, wherein said control arrangement includes means for moving said developing unit away from said rotatable endless surface in said refurbishment mode.

8. A printer according to claim 1, in the form of a multi-station printer comprising a plurality of said image-producing stations, said printer including means for conveying said image receiving web in succession past each of said image-producing stations.

9. A printer according to claim 6, further comprising drive means for moving said developing unit between said operating and non-operating positions.

10. A printer according to claim 6, further comprising control means for controlling the timed relationship between movement of said developing unit and operation of said printer.

11. A printer according to claim 1, wherein said image-producing station comprises a driven rotatable magnetic developing brush and a driven rotatable cleaning brush, both in frictional contact with said rotatable endless surface in said printing mode, said brushes rotating in mutually opposite directions.

12. A printer according to claim 11, wherein the extent of frictional contact of said developing brush and said cleaning brush with said rotatable endless surface are such, in said printing mode, that the resultant torque transmitted to said rotatable endless surface is substantially zero.

13. A printer according to claim 11, wherein the position of at least one of said brushes relative to said endless rotatable endless surface is adjustable thereby to adjust the extent of frictional contact between that brush and said rotatable endless surface in said printing mode.

14. A printer according to claim 1, wherein said rotatable endless surface is the circumferential surface of a drum.

15. A process of operating an electrostatographic printer wherein a toner image is formed on a rotatable endless surface at an image producing station, a web is conveyed past said image producing station and said toner image is transferred to a printing web at said station, the process being characterized by a printing mode in which a printing web is conveyed in synchronism with said endless surface to receive said toner image, and a refurbishment mode wherein said endless surface is driven at a higher peripheral speed than in said printing mode, wherein a refurbishment web is conveyed past said image producing station in contact with said endless surface and at a relative speed with respect thereto to refurbish said surface.

16. A process according to claim 15, wherein said printing mode and said refurbishment modes are carried out sequentially by conveying a single web having a refurbishment web portion and a printing web portion.

17. A process according to claim 15, wherein said step of conveying a refurbishment web comprises conveying a web with an abrasive surface.

18. A process according to claim 17, wherein said step of conveying a refurbishment web comprises conveying at least one abrasive sheet secured to said refurbishment web.

19. A process according to claim 17, wherein said step of conveying a refurbishment web comprises conveying a web having an abrasive coating thereon.

20. A process according to claim 17, wherein said step of conveying a refurbishment web comprises conveying a web having an abrasive strip positioned obliquely across said refurbishment web.

21. A process according to claim 15, wherein said refurbishment web is separate from said printing web, and wherein said conveying step of said refurbishment mode comprises moving a refurbishment web station toward said endless surface and conveying said refurbishment web past said refurbishment web station.

22. A process according to claim 15, wherein said refurbishment mode further comprises supplying said refurbishment web from a supply roll and conveying said refurbishment web to a take-up roll.

23. A process according to claim 17, wherein said step of conveying a refurbishment web comprises conveying a web having successive abrasive materials having diminishing abrasive characteristics.

24. A process according to claim 15, wherein in said refurbishment mode said relative peripheral speed is between 150 and 220 cm./s.

* * * * *